United States Patent [19]

Mailloux et al.

[11] 4,120,580

[45] Oct. 17, 1978

[54] COLLATING SYSTEM FOR SLIDE REPRODUCTION

[75] Inventors: Louis D. Mailloux, Fairport; James E. Bollman, Williamson, both of N.Y.

[73] Assignee: Xerox Corporation, Stamford, Conn.

[21] Appl. No.: 701,447

[22] Filed: Jun. 30, 1976

[51] Int. Cl.[2] ..... G03G 15/00

[52] U.S. Cl. ..... 355/14; 355/3 R

[58] Field of Search ..... 355/3 R, 4, 14, 5, 6

[56] References Cited

U.S. PATENT DOCUMENTS

| | | | |
|---|---|---|---|
| 2,889,758 | 6/1959 | Bolton | 355/6 |
| 3,138,458 | 6/1964 | Kimble et al. | 355/4 X |
| 3,276,314 | 10/1966 | Robinson | 353/111 X |
| 3,597,076 | 8/1971 | Hubbard | 355/3 R X |
| 3,917,400 | 11/1975 | Rodek et al. | 355/14 X |
| 3,977,780 | 8/1976 | Cassano et al. | 355/3 R X |
| 4,013,355 | 3/1977 | Mailloux | 355/4 |

*Primary Examiner*—William M. Shoop

[57] ABSTRACT

An electrostatographic printing machine in which a plurality of transparencies are reproduced. The transparencies are stored in an ordered sequence and advanced automatically into communication with the reproduction system so as to form ordered sets of copies thereof.

17 Claims, 4 Drawing Figures

COLLATING SYSTEM FOR SLIDE REPRODUCTION

The foregoing abstract is neither intended to define the invention described in the specification, nor is it intended to be limiting as to the scope of the invention in any way.

BACKGROUND OF THE INVENTION

This invention relates generally to an electrostatographic printing machine, and more particularly concerns a printing machine arranged to reproduce a plurality of sets of transparencies having an ordered sequence.

An electrostatographic process involves the formation and utilization of electrostatic latent charge patterns for the purpose of recording and reproducing the patterns in viewable form. The field of electrostatographic printing includes electrophotographic and electrographic printing. Electrophotographic printing is that class of electrostatographic printing which employs the photosensitive medium to form, with the aid of electromagnetic radiation, the electrostatic latent charge pattern. Xerography, which employs infrared, visible or ultraviolet radiation and xeroradiography are sub-classes of electrophotography. Electrography is that class of electrostatography which utilizes an insulating medium to form, without the aid of electromagnetic radiation, the electrostatic latent charge pattern. Xero printing, which uses the pattern of insulating material on a conductive medium to form electrostatic charge patterns and electrographic recording, which uses a charge transfer between the plurality of electrodes to form directly electrostatic charge patterns, are sub-classes of electrographic printing. In all of the foregoing machines, it is highly desirable to be capable of reproducing transparencies. More particularly, it is highly advantageous to provide a plurality of transparencies in an ordered sequence with each transparency being reproduced sequentially so as to produce a plurality of sets of collated copies.

The process of electrophotographic printing will be described hereinafter as an examplary system for achieving the foregoing. An electrophotographic printing machine exposes a charged photoconductive member to a light image of a transparency being reproduced. The irradiated areas of the photoconductive surface are discharged to record thereon an electrostatic latent image corresponding to the transparency. A development system moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. After transferring the toner powder image from the latent image to the sheet of support material, a fusing device permanently affixes the toner powder image thereto. The foregoing briefly the basic operation of an electrophotographic printing machine. This concept was originally disclosed by Carlson in U.S. Pat. No. 2,297,691 and is further amplified and described by many related patents in the art.

Many special purpose electrophotographic printing machines have been developed and are in wide commercial use. For example, electrophotographic printing machines are presently commercially available for reproducing microfilm. Machines of this type are described in U.S. Pat. No. 3,424,525 issued to Towers et al. in 1969; U.S. Pat. No. 3,542,468 issued to Blow, Jr. in 1970; and U.S. Pat. No. 3,547,533 issued to Stokes et al. in 1970. In general, a microfilm reproducing machine produces an enlarged copy of a microfilm original. However, high quality reproduction of color slides has only been recently achieved. This process is exemplified by co-pending application Ser. No. 540,617 filed in 1975, and co-pending application Ser. No. 663,389 filed in 1976. As disclosed in the foregoing applications, a light image of a color transparency is projected onto a mirror. The mirror reflects the light image through a screen and field lens onto the charged portion of the photoconductive surface. This light image is filtered to record a single color electrostatic latent image on the photoconductive surface. Successive single electrostatic latent images are recorded and developed with the appropriately colored toner particles. These toner powder images are transferred to a sheet of support material, in superimposed registration with one another. This multilayered tone powder image is then permanently affixed to the sheet of support material forming a copy of the color slide being reproduced. Improvements in this basic process include positioning a mirror in the path of the transparency light image to direct the light image onto the charged portion of the photoconductive member with the mirror being readily removable from the optical light path so as to reproduce opaque original documents.

It has been found to be highly desirable to place a set of slides in a slide projector, in an ordered sequence, and automatically index these slides to form a plurality of collated sets of copies.

Accordingly, it is a primary object of the present invention to improve electrostatographic printing machines by reproducing sets of collated copies from an ordered arrangement of transparencies.

SUMMARY OF THE INVENTION

Briefly stated, and in accordance with the present invention, there is provided an electrostatographic printing machine for reproducing a plurality of transparencies.

Pursuant to the features of the present invention, the electrostatographic printing machine includes means for storing the transparencies in an ordered sequence. Reproducing means are provided to form copies of the transparencies. Means, operatively associated with the storing means, index automatically the storing means to advance successive transparencies into communication with the reproducing means. This enables the reproducing means to form successive copies of the transparencies in an ordered sequence forming collated sets thereof.

BRIEF DESCRIPTION OF THE DRAWINGS

Other objects and advantages of the present invention will become apparent upon reading the following detailed description and upon reference to the drawings, in which.

Figure 1:
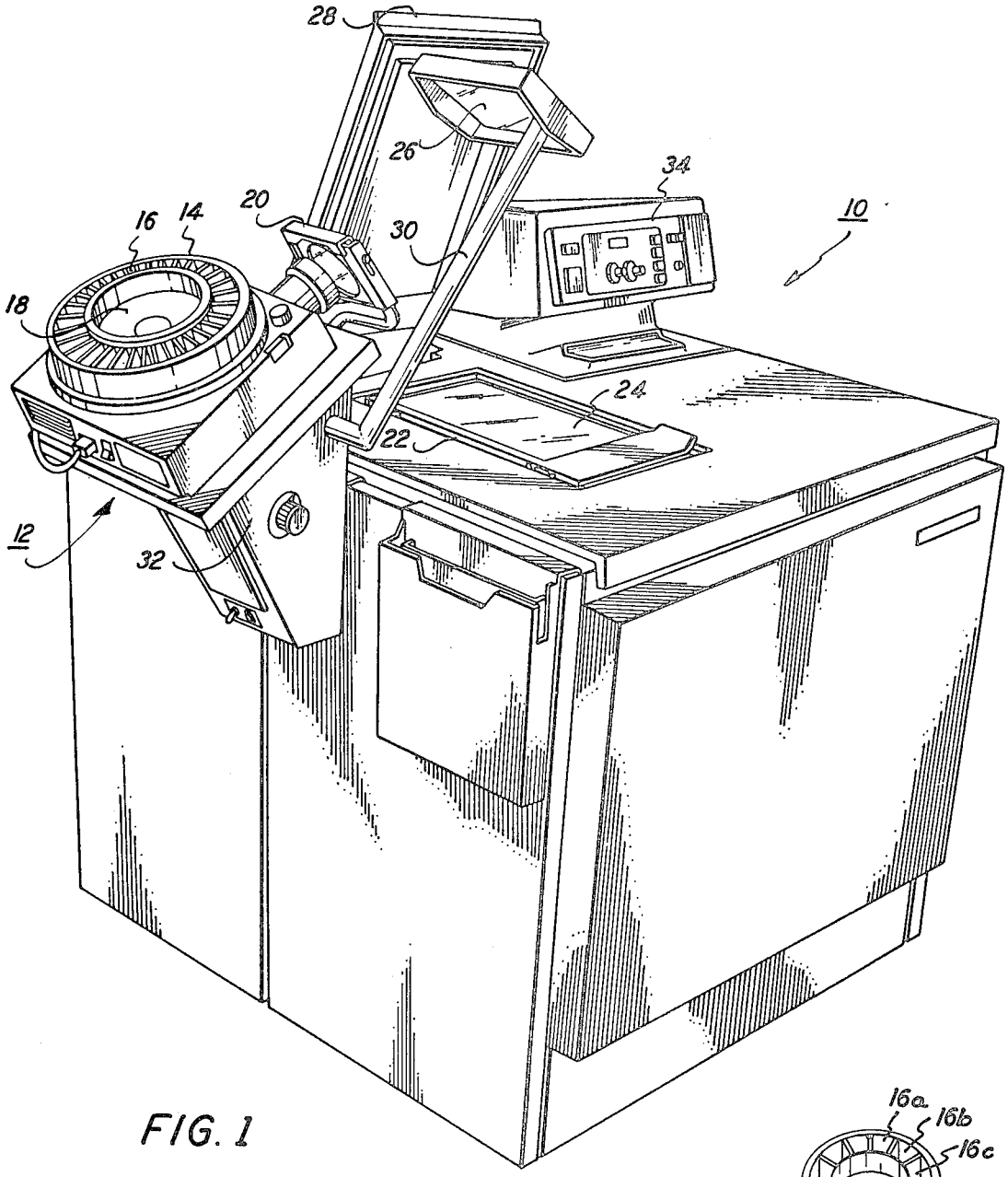
FIG. 1 is a perspective view of an electrophotographic printing machine incorporating the features of the present invention therein.

While the present invention will hereinafter be described in connection with a preferred embodiment thereof, it is understood that it is not intended to limit the invention to that embodiment. On the contrary, it is intended to cover all alternatives, modifications and equivalents as may be included within the spirit and scope of the invention as defined by the appended claims.

DETAILED DESCRIPTION

For a general understanding of an electrophotographic printing machine incorporating the features of the present invention therein, continued reference is had to the drawings. In the drawings, like reference numerals have been used throughout to designate identical elements. Although the electrophotographic printing machine of the present invention is particularly well adapted for reproducing color transparencies, or for reproducing single or multiple copies of opaque original documents, it should become evident from the following discussion that it is equally well suited for use in a wide variety of applications such as producing black and white copies from black and white transparencies or from black and white opaque original documents, and is not necessarily limited to the particular embodiment shown herein. The features of the present invention may be employed in any suitable electrostatographic printing machine and the electrophotographic printing machine shown herein incorporating these features is merely exemplary thereof.

Figure 3:
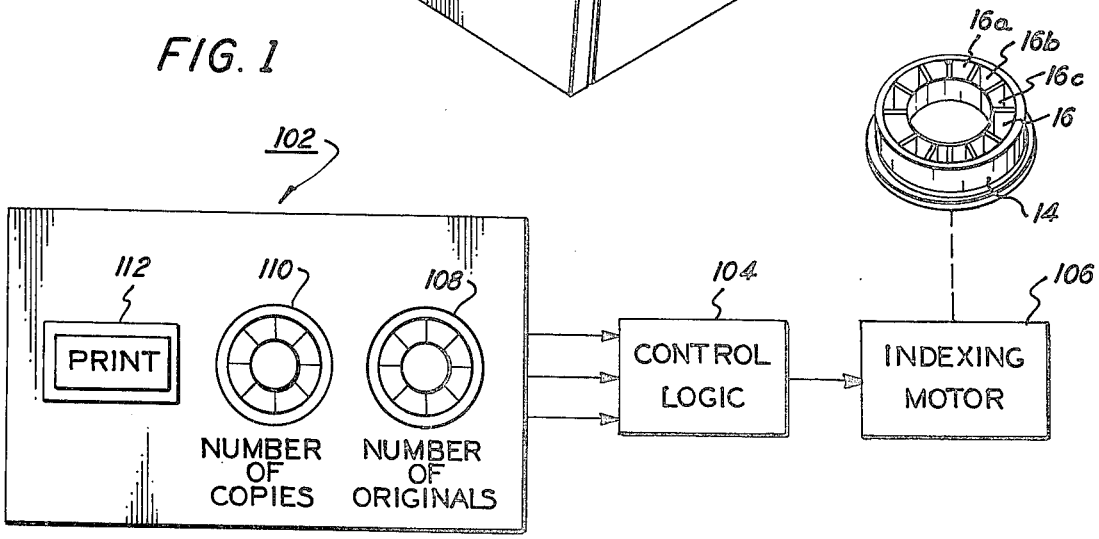
FIG. 3 is an elevational view depicting, with block diagrams, control of the FIG. 1 printing machine.
Figure 4:
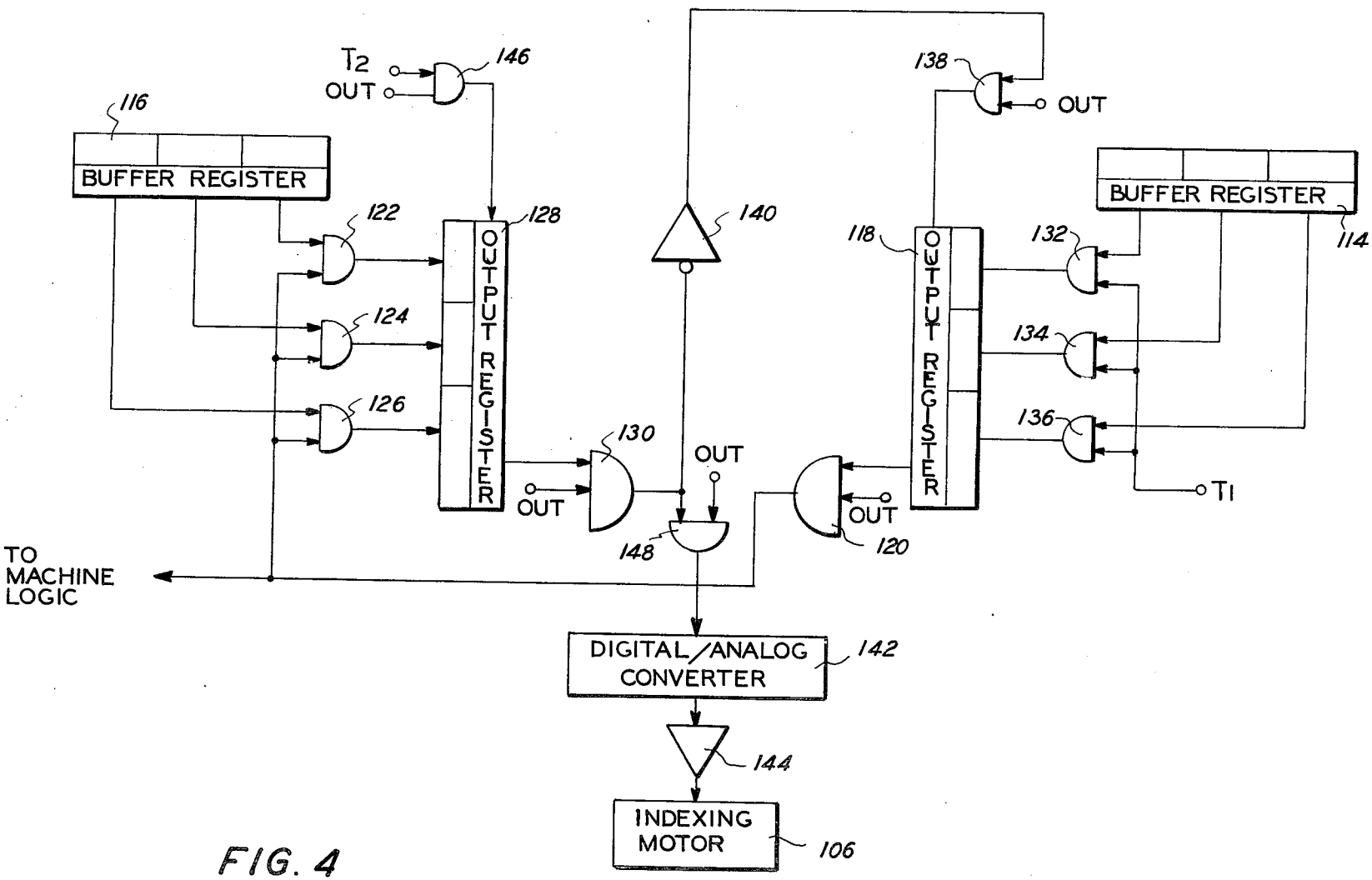
FIG. 4 is a logic diagram showing the FIG. 3 control logic.

As shown in FIG. 1, the reproducing machine or electrophotographic printing machine indicated generally by the reference numeral 10 has a slide projector 12 mounted thereon. Slide projector 12 includes a cylindrical member 14 having a plurality of compartments 16 therein. Internal to slide projector 12 is an indexing motor. Cylindrical member 14 is mounted on shaft 18 of the indexing motor and rotates therewith. In this manner, after a copy of the transparency or color slide positioned in one of compartments 16 of cylindrical member 14 is reproduced, the indexing motor is actuated advancing the cylindrical member to position the next compartment, with the slide therein, in communication with the reproducing machine so as to be copied thereby. In operation, slide projector 12 projects a light image of a transparency disposed in one of the compartments 16 through a notch filter 20 which serves to correct the colors of the printing machine filters. The light image is reflected through screen 22 and Fresnel lens 24 disposed on the printing machine platen by a mirror 26. In the transparency reproduction mode, cover 28 is positioned in the opened position, as shown in FIG. 1. Contrawise, in the opaque reproduction mode, cover 28 is closed, i.e., in contact with the opaque original document disposed upon the printing machine platen with screen 22 and Fresnel lens 24 being removed therefrom. The foregoing is achieved by pivoting mirror 26 from the operative position in the optical light path to the inoperative position spaced therefrom. Mirror 26 is mounted rotatably on arm 30. Arm 30, in turn, is mounted pivotably on frame 32 supporting slide projector 12. Thus, arm 30 is rotated to permit cover 28 to be closed when the printing machine is converted from a transparency reproducing machine to an opaque reproducing machine. Control panel 34 includes the requisite controls for indicating the number of copies and the number of originals to be reproduced from each slide. The electrical circuitry coupling slide projector 12 and its corresponding indexing motor with reproducing machine 10 is at least partially in control panel 34. A fragmentary schematic of control panel 34 showing these features is depicted in FIG. 3. The control circuitry associated therewith for indexing the slides being reproduced is depicted in FIG. 4. The various processing stations and detailed structure of printing machine 10 is shown in FIG. 2.

Figure 2:
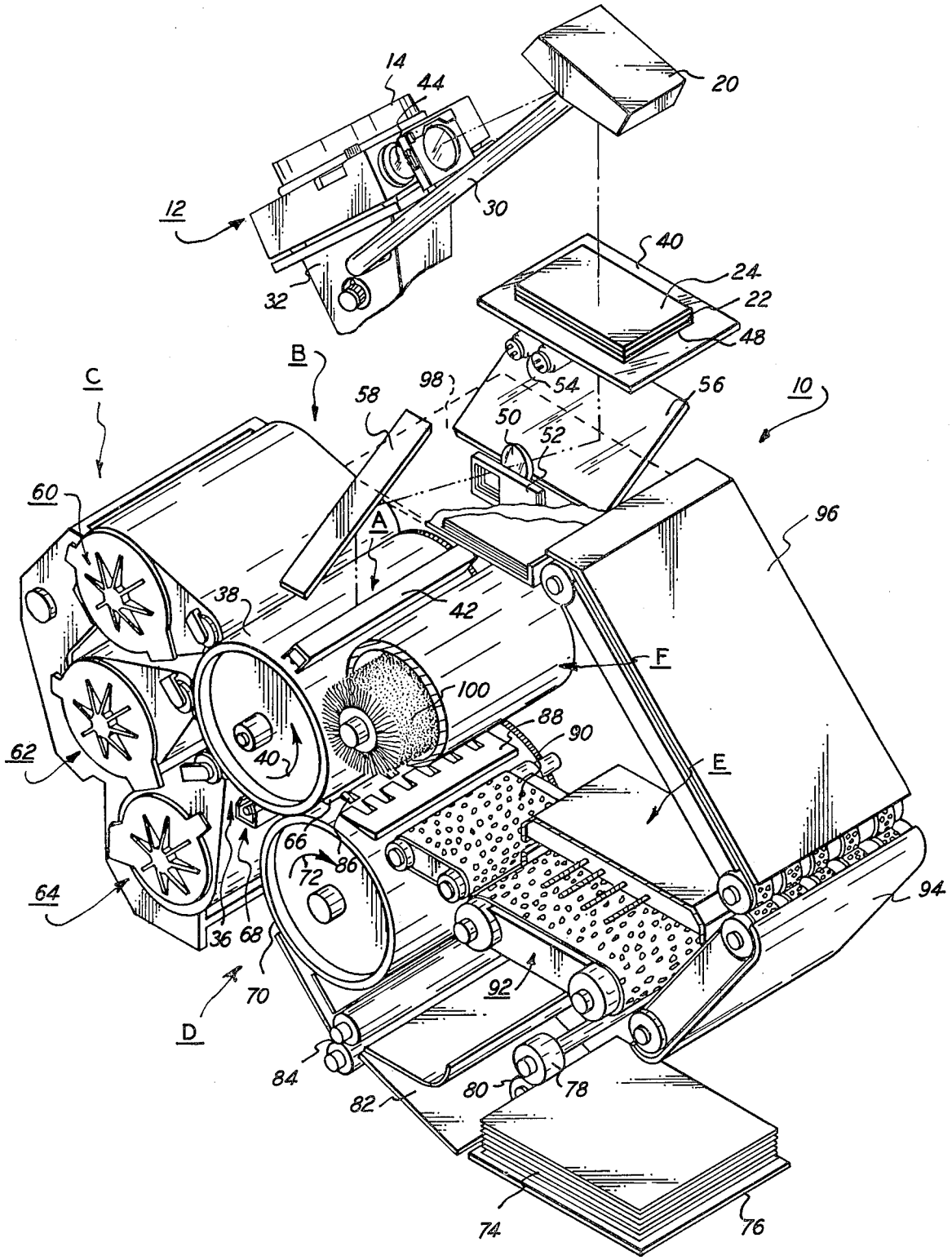
FIG. 2 is a schematic perspective view illustrating the processing stations in the FIG. 1 printing machine.

Turning now to FIG. 2, an illustrative schematic of the printing machine is depicted thereat. Electrophotographic printing machine 10 employs a photoconductive member having a drum 36 mounted rotatably within the printing machine frame (not shown) with photoconductive surface 38 secured thereto and entrained thereabout. Preferably, photoconductive surface 38 is made from a suitable panchromatic selenium alloy such as is described in U.S. Pat. No. 3,655,377 issued to Sechak in 1972.

As drum 36 rotates in the direction of arrow 40, a portion of photoconductive surface 12 passes through a series of processing stations located about the periphery thereof. Drum 36 is rotated at a substantially constant angular velocity so that the proper sequencing of events may occur at each of the processing stations. Timing for each event is achieved by a signal generator (not shown) operatively associated with drum 36. The signal generator develops electrical pulses which are processed by the machine logic so that each processing station is activated at the appropriate time during the rotation of drum 36. In addition, these pulses serve to provide timing pulses for the control logic coupling slide projector 12 with reproducing machine 10. One type of suitable signal generator is a disc having a plurality of slits in the periphery thereof mounted on the shaft of drum 36 so as to rotate therewith. Positioned on one side of the slit is a light source, and, located on the other side of the slit, a photosensor. The disc is opaque and light rays are only transmitted to the photosensor when a slit is interposed between the photosensor and light source. Thus, the photosensor detects periodic pulses of light. The photosensor, in turn, develops electrical pulses corresponding thereto which are processed by the machine logic and serve as timing signals.

Initially, drum 36 rotates through charging station A. At charging station A, a corona generating device, indicated generally by the reference numeral 42, charges at least a portion of photoconductive surface 38 to a relatively high, substantially uniform level. A suitable corona generating device is described in U.S. Pat. No. 3,875,407 issued to Hayne in 1975. After photoconductive surface 38 is charged to a substantially uniform level, drum 36 rotates the charged portion thereof to exposure station B. At exposure station B, a color filtered light image of the color transparency disposed in compartment 16 of slide projector 12, as examplified by a 35mm slide, is projected onto the charged portion of photoconductive surface 38. The indexing motor of slide projector 12 advances the appropriate compartment 16 having a color slide therein to the projector system of slide projector 12. Slide projector 12 includes a light source adapted to illuminate the color transparency and a lens 44 having an adjustable focus to produce an enlarged or magnified image thereof. Frame 32 supports slide projector 12. Arm 30 has one end portion thereof mounted pivotably on frame 32. The other end portion thereof is secured rotatably to mirror 20. In this way, arm 30 may be pivoted relative to frame 32 to move mirror 20 out of the path of the transparency light image when an opaque original document is being reproduced by the electrophotographic printing machine. Contrawise, when a transparency is being reproduced, arm 30 is pivoted to position mirror 20 in the path of the transparency light image. Thus, the light image of the transparency is projected from slide projector 12 to mirror 20. Mirror 20 directs the light image through a field lens such as Fresnel lens 24. Mirror 20 is mounted rotatably on arm 30 so as to be capable of directing the light image in the desired direction, i.e., transmitted through Fresnel lens 24. Interposed between Fresnel lens 24 and transparent platen 46 is an optional opaque sheet 48 having an aperture therein, i.e., a picture frame or informational frame, which may be considered a composition frame. Composition frame 48 defines an opaque border extending outwardly from the light image of the color transparency. Frame 48 may have indicia inscribed thereon. Screen 22 may be disposed beneath Fresnel lens 24, i.e., interposed between Fresnel lens 24 and composition frame 48. Screen 22 modulates the color transparency light image forming a half-tone light image thereof. A scanning system is disposed beneath platen 46 and includes a moving lens system, designated generally by the reference numeral 50, and a color filter mechanism, shown generally at 52. Lamps 54 move in a timed relationship with lens 50 and filter mechanism 52 to scan and illuminate successive incremental areas of composition frame 48. In this manner, a half-tone light image of the color transparency may be combined with the light image of the composition frame to form a combined image. This combined image is transmitted onto the charged portion of photoconductive surface 38 to selectively dissipate the charge thereon recording an electrostatic latent image.

Platen cover (FIG. 1) must be pivoted to the opened position permitting arm 30 to rotate so as to locate mirror 20 in the path of the transparency light image. Contrawise, when an opaque original document is being reproduced, arm 20 rotates to a position remote from the path of the transparency light image permitting platen cover 28 to be closed.

With continued reference to FIG. 1, screen 22 is interposed between composition frame 48 and Fresnel lens 24. Slide projector 12 projects the transparency light image onto mirror 20 which reflects it in a downwardly direction to pass through screen 22 so as to be modulated thereby. The combined light image of the transparency and composition frame is reflected by mirror 56 through lens 50 and filter 52 forming a single color light image. This single color light image is reflected by mirror 58 onto the charged portion of photoconductive surface 38. Thus, the modulated single color light image irradiates the charged portion of photoconductive surface 38 recording a single color electrostatic latent image thereon. Similarly, the light image of composition frame 48 irradiates the charged portion of photoconductive surface 38 forming an un-modulated image thereof in registration with the single color electrostatic latent image formed from the modulated light image of the color transparency.

Filter mechanism 52 interposes selected color filters into the optical light path during the exposure process. These filters operate on the light rays transmitted through lens 50 to form a light image corresponding to a single color of the transparency. Preferably, filter mechanism 52 includes a housing which is mounted on lens 50 by a suitable bracket and moves therewith during scanning as a single unit. The housing of filter 52 includes a window which is positioned relative to lens 50 permitting the light rays of the combined image, i.e., that of the composition frame and transparency, to pass therethrough. Bottom and top walls of the housing include a plurality of tracks which extend the entire width thereof. Each track is adapted to carry a filter to permit movement thereof from an inoperative position to an operative position. In the operative position, the filter is interposed into the window of the housing permitting light rays to pass therethrough. Individual filters are made from any suitable filter material such as coated glass. Preferably, three filters are employed in the electrophotographic printing machine depicted in FIG. 1, a red filter, a blue filter and a green filter. A detailed description of the filter mechanism is found in U.S. Pat. No. 3,775,006 issued to Hartman et al. in 1973.

Lamps 54 traverse platen 46 to illuminate incremental areas of composition frame 48. In this way, the light rays from composition frame 48 and the modulated light image of the transparency are transmitted through lens 50. Preferably, lens 50 is a six-element split dagor type of lens having front and back compound lens components with a centrally located diaphragm therebetween. Lens 50 forms a high quality image with a field angle of about 31° and a speed ranging from about F/4.5 to about F/8.5 at a 1:1 magnification. Moreover, lens 50 is designed to minimize the effect of secondary color in the image plane. The front lens component has three lens elements including, in the following order, a first lens element of positive power, a second lens element of negative power cemented to the first lens element, and a third lens element of positive power disposed between the second lens element and the diaphragm. The back lens component also has three similar lens components positioned so that lens 50 is symmetrical. Specifically, the first lens element in the front component is a double convex lens, the second lens element a double concave lens and the third element a convex-concave lens element. For greater details regarding lens 50, reference is made to U.S. Pat. No. 3,592,531 issued to McCrobie in 1971.

By way of example, projector 12 preferably is a modified Kodak carousel 600 projector having an F/3.5 Ektaner C projection lens and a quartz lamp. The drive system for rotating successive individual slides is electrically coupled to the reproducing machine logic. In this manner, successive slides may be automatically indexed so that the resultant set of copies are collated. Thus, the machine operator places a plurality of slides in the compartments of the cylindrical member. Thereafter, each slide is sequentially copied and a plurality of sets are formed. In this manner, collated copy sets are obtained from a pre-collated set of slides.

Fresnel lens 24 comprises a plurality of small light deflecting elements that provide a uniform distribution of light over a predetermined area. Preferably, there are 200 or more gratings per inch. This field lens converges the diverging light rays from lens 44 of slide projector 12 to insure that the light rays transmitted through platen 46 are substantially parallel. Other types of field lenses may be employed in lieu of a Fresnel lens, provided that they converge the diverging light rays to form substantially parallel light rays passing through platen 46.

As heretofore noted, screen 22 modulates the light image to form a half-tone light image. Preferably, screen 42 includes a plurality of spaced opaque dots disposed on a substantially transparent sheet. The spacing between adjacent dots determines the quality of the resulting copy. A fine screen size generally results in a more natural or higher quality copy. Preferably, screen 22 has a plurality of equally spaced, soft gray square dots comprising about 85 dots per inch. However, this may range from about 65 to about 300 dots per inch. The foregoing is only limited by the optical system and the desired resolution. A suitable dot screen for disposition on the platen is manufactured by Caprock Corporation and may be a negative screen. An optical system employing such a screen for reproducing transparencies is described in co-pending application Ser. No. 540,617 filed in 1975. One skilled in the art will appreciate that this screen may also be a suitable line screen rather than a dot screen.

With continued reference to FIG. 2, after the electrostatic latent image is recorded on photoconductive surface 38, drum 36 rotates to development station C. At development station C, three individual developer units, generally indicated by the reference numerals 60, 62 and 64, respectively, are arranged to render visible the electrostatic latent image recorded on photoconductive surface 38. Preferably, each of the developer units are of the type generally referred to in the art as "magnetic brush developer units". A typical magnetic brush developer unit employs a magnetizable developer mix which includes ferromagnetic carrier granules and heat settable thermoplastic toner particles. The toner particles are triboelectrically attracted to the carrier granules. In operation, the developer mix is continually brought through a directional flux field forming a chain-like array of fibers extending downwardly from the developer roll of the respective developer unit. This chain-like array of fibers is frequently termed a brush. The electrostatic latent image recorded on photoconductive surface 38 is rotated into contact with the brush of developer mix. Toner particles are attracted from the carrier granules to the latent image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. A development system of this type is described in U.S. Pat. No. 3,854,449 issued to Davidson in 1974.

After the single color electrostatic latent image is developed, drum 36 rotates to transfer station D. At transfer station D, the toner powder image adhering electrostatically to photoconductive surface 38 is transferred to a sheet of support material 66. Support material 66 may be a sheet of paper or plastic material, amongst others. Transfer station D includes corona generating means, indicated generally by the reference numeral 68, and a transfer roll, designated generally by the reference numeral 70. Corona generator 68 is excited with an alternating current and arranged to precondition the toner powder image electrostatically adhering to photoconductive surface 38. In this manner, the pre-conditioned toner powder image will be more readily transferred from the electrostatic latent image recorded on photoconductive surface 38 to support material 66 secured releasably on transfer roll 70. Transfer roll 70 recirculates support material 66 and is electrically biased to a potential of sufficient magnitude and polarity to attract electrostatically the pre-conditioned toner particles from the latent image recorded on photoconductive surface 38 to support material 66. Transfer roll 70 rotates in the direction of arrow 72, in synchronism with drum 36, to rotate support material 66 in registration with the toner powder images developed on photoconductive surface 38. This enables successive toner powder images to be transferred to support material 66 in superimposed registration with one another. U.S. Pat. No. 3,838,918 issued to Fisher in 1974 discloses a suitable transfer system of this type.

Prior to proceeding with the remaining processing stations, the sheet feeding apparatus will be briefly described. Support material 66 is advanced from a stack 74 disposed on tray 76. Feed roll 78, in operative communication with retard roll 80, advances and separates the uppermost sheet from stack 74. The advancing sheet moves into chute 82 which directs it into the nip between register rolls 84. Register rolls 84 align and forward the sheet to gripper fingers 86 mounted on transfer roll 70 which secure support material 66 releasably thereon. After the requisite number of toner powder images have been transferred to support material 66, gripper fingers 86 release support material 66 and space it from transfer roll 70. As transfer roll 70 continues to rotate in the direction of arrow 72, stripper bar 88 is interposed therebetween. Support material 66 then passes over stripper bar 88 onto endless belt conveyor 90. Endless belt conveyor 90 advances support material 66 to fixing station E.

At fixing station E, a fuser, indicated generally by the reference numeral 92, generates sufficient heat to permanently affix the multi-layered powder image to support material 66. A suitable fusing device is described in U.S. Pat. No. 3,781,516 issued to Tsilibes et al. in 1973. After the fixing process, support material 66 is advanced by endless belt conveyors 94 and 96 to catch tray 98 permitting the machine operator to remove the finished color copy from the printing machine.

Although a preponderance of the toner particles are transferred to support material 66, invariably some residual toner particles remain adhering to photoconductive surface 38 after the transfer process. These residual toner particles are removed from photoconductive surfacd 38 at cleaning station F. Cleaning station F includes a corona generating device (not shown) for neutralizing the electrostatic charge remaining on the residual toner particles and photoconductive surface 38. The neutralized toner particles are then cleaned from photoconductive surface 38 by a rotatably mounted fibrous brush 100 in contact therewith. A suitable brush cleaning device is described in U.S. Pat. No. 3,590,412 issued to Gerbasi in 1971.

It is believed that the foregoing description is sufficient for purposes of the present application to illustrate the general operation of an electrophotographic printing machine incorporating the features of the present invention therein.

Referring now to FIG. 3, the specific transparency pre-collation mode of operation will be discussed. In operation, the machine operator dials the number of copies i.e., the number of sets to be reproduced and the number of originals being reproduced. For example, if five transparencies are to be reproduced as five ordered sets of copies, the five transparencies will initially be placed in compartments 16 of cylindrical member 14. Thus, the operator will set the number of copies at 5 and the number of originals at 5. At this time, the operator will depress the print button. Thereafter, the printing machine control logic in association with control logic 104 will program the movement of cylindrical member 16 so that slide projector 12 projects successive light images of each color transparency. The foregoing is repeated for five cycles so that five sets of copies are produced. These sets of copies are in an ordered sequence. Cylindrical member 14 acts as a storage container for the various slides. Control logic 104 regulates the actuation of indexing motor 106 so as to rotate cylindrical member 14 at the appropriate time. For example, if the slide in compartment 16*a* is initially being reproduced, indexing motor 106 will be actuated by the control logic to advance compartment 16*b* into operative communication with the projection system of slide projector 12 after the first copy of the slide in compartment 16*a* has been obtained. Similarly, after the first copy of the slide in compartment 16*b* has been obtained, indexing motor 106 is again actuated by control logic 104 to rotate cylindrical member 14 such that the slide in compartment 16*c* is in operative communication with projection system of slide projector 12. The foregoing is repeated for the total number of slides contained within compartments 16 of cylindrical member 14. After the first set of copies has been obtained, this cycle is repeated for the next successive set of copies. In this manner, the resultant copies are in an ordered sequence and the requisite number of sets are obtained thereby. The foregoing is accomplished by setting dial 108 at the number of originals being reproduced and dial 110 at the required number of copies. Thereafter, print button 112 is depressed and the foregoing sequence of events occurs. Referring now to FIG. 4, the details of this scheme will be discussed.

An exemplary logic diagram for reproducing three sets having three copies in each set is shown in FIG. 4. One skilled in the art may readily expand this as required. Initially, the number of copies is set on dial 110 which loads buffer register 114. Similarly, dialing the number of originals on dial 108 loads buffer register 116. Activation of print button 112 initiates the cycle. Timing pulse $T_1$ is generated when print button 112 is activated. During timing pulse $T_1$ AND gates 132, 134 and 136 are high and load output register 118. At this time the signal from AND gate 130 is low. Inverter 140 changes the signal from AND gate 130 to high and AND gate 138 has a high output shifting the output content of register 118 one bit. This bit activates AND gate 120 and the signal therefrom is high. A high signal from AND gate 120 activates AND gates 122, 124 and 126 to generate a high signal loading register 128. During timing pulse $T_2$ i.e., the timing pulse which indicates that a copy has been completed, the output content of register 128 is shifted one bit. This bit activates AND gate 130. The output signal from AND gate 130 is high producing a low signal from inverter 140 inhibiting AND gate 138. The output signal from AND gate 130 also activates AND gate 148 producing a pluse therefrom which is converted to an analog signal by digital to analog converter 142. Amplifier 144 amplifies this signal which actuates indexing motor 106. Indexing motor 106 advances the next successive compartment 16 into communication with the projection system of slide projector 12. In this way, the next successive slide may be copied. AND gate 138 is inhibited until register 128 is unloaded. At that time, AND gate 130 is low. The signal therefrom is inverted, once again actuating AND gate 138 which produces high signal. This signal shifts the output content of register 118 a second bit repeating the previous cycle for all of the slides to form a second set of copies. This process is repeated until register 118 is unloaded. At this time, the copying cycle is completed. When the copying cycle is completed, the machine logic process the signal from AND gate 120 to inactivate printing machine 10.

In recapitulation, the electrophotographic printing machine heretofore described is adapted to reproduce successive ordered sets of colored slides. This is achieved automatically by pre-collating the slides prior to their reproduction. The output from the printing machine is a plurality of collated sets of copies. Thus, the printing machine creates a plurality of collated sets of copies by pre-collating the slides and automatically indexing each slide after a copy thereof has been made for the requisite number of cycles.

Thus, it is apparent that there has been provided, in accordance with the present invention, an electrophotographic printing machine that fully satisfies the objects, aims and advantages hereinbefore set forth. While this invention has been discussed in conjunction with a psecific embodiment thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. An electrostatographic printing machine for reproducing a plurality of transparencies, including:
   - means for storing the transparencies in an operator selectable ordered sequence;
   - means for reproducing each one of the transparencies to form at least one set of copies thereof;
   - means, operatively associated with said storing means, for indexing automatically said storing means to advance successive transparencies into cummunication with said reproducing means to form copies thereof; and
   - programming means, coupling said reproducing means with said storing means, for actuating said storing means in response to said reproducing means completing the copying of one of the transparencies to advance the next successive transparency into communication with said reproducing means to form a copy thereof.

2. A printing machine as recited in claim 1, wherein said storing means includes a cylindrical member having a plurality of radially extending compartments, each compartment being arranged to have a transparency disposed therein.

3. A printing machine as recited in claim 2, wherein said indexing means includes
   - an indexing motor having said cylindrical member mounted rotatably thereon.

4. A printing machine as recited in claim 3, wherein said reproducing means includes:
   - a photoconductive member;
   - means for charging at least a portion of said photoconductive member to a substantially uniform level; and
   - means, coupled to said cylindrical member, for projecting a light image of one of the transparencies onto the charged portion of said photoconductive member selectively dissipating the charge thereon to record an electrostatic latent image thereof.

5. A printing machine as recited in claim 4, wherein said reproducing means includes:

a receiving member;

a composition frame disposed on said receiving member; and means for exposing the charged portion of said photoconductive member to a light image of said composition frame recording thereon a combined electrostatic latent image comprising the electrostatic latent image of the transparency and the electrostatic latent image of said composition frame.

6. A printing machine as recited in claim 5, wherein said reproducing means includes means for filtering the light image of the transparency to form a single color light image thereof which irradiates the charged portion of said photoconductive member to record thereon a single color electrostatic latent image.

7. A printing machine as recited in claim 6, wherein said reproducing means includes means for modulating the light image of the transparency.

8. A printing machine as recited in claim 7, wherein said receiving member includes:

a transparent platen member having said composition frame disposed thereon; and a field lens mounted on said composition frame.

9. A printing machine as recited in claim 8, wherein said modulating means includes a screen interposed between said field lens and said composition frame.

10. A printing machine as recited in claim 9, wherein said projecting means includes a slide projector arranged to project a light image of successive transparencies.

11. A printing machine as recited in claim 10, wherein said exposing means includes:

a light source arranged to illuminate said composition frame disposed on said receiving member; and lens means for receiving the light rays from the combined image of the transparency and said composition frame.

12. A printing machine as recited in claim 11, further including means, movable from a first position remote from the path of the light image to reproduce an opaque original document to a second position in the path of the light image to reproduce the transparency, for directing the light image of the transparency onto the charged portion of said photoconductive member.

13. An electrophotographic printing machine for reproducing a plurality of transparencies, including:

a cylindrical member having a plurality of radially extending compartments for holding a transparency therein;

a photoconductive member;

means for charging at least a portion of said photoconductive member to a substantially uniform level;

a slide projector arranged to project a light image of successive transparencies;

a transparent platen member;

a composition frame disposed on said transparent platen member;

a field lens mounted on said composition frame;

a screen interposed between said field lens and said composition frame;

an indexing motor having said cylindrical member mounted rotatably thereon;

programming means for actuating said indexing motor in response to completing the copy of one of the transparencies to advance the next successive transparency into communication with said slide projector;

a frame supporting said slide projector;

an arm having one end portion thereof mounted pivotably on said frame;

a mirror mounted movably on the other end portion of said arm to direct the light image of the transparency through said transparent platen, said composition frame, said screen and said field lens;

a light source arranged to illuminate said composition frame disposed on said transparent platen member;

lens means for receiving the light rays from the combined image of the transparency and said composition frame; and means for filtering the combined light image of the composition frame and transparency to form a single color light image thereof which irradiates the charged portion of said photoconductive member to record thereon a single color electrostatic latent image.

14. A printing machine as recited in claim 13, wherein said filtering means includes:

a red filter arranged to be interposed into the light image path to transmit a red light image therethrough;

a blue filter arranged to be interposed into the light image path to transmit a blue light image therethrough; and a green filter arranged to be interposed into the light image path to transmit a green light image therethrough.

15. A printing machine as recited in claim 14, wherein said screen includes a plurality of spaced, soft gray square dots.

16. A printing machine as recited in claim 15, wherein said screen includes preferably about 85 dots per inch.

17. A printing machine as recited in claim 16, wherein said field lens includes a Fresnel lens having preferably about 200 gratings per inch.

* * * * *